US006560987B2

(12) United States Patent
Kreger et al.

(10) Patent No.: US 6,560,987 B2
(45) Date of Patent: May 13, 2003

(54) DUAL RESTRICTOR SHUT-OFF VALVE FOR PRESSURIZED FLUIDS OF AIR COOLING/ HEATING APPARATUS

(75) Inventors: Ross Edward Kreger, Ida, MI (US); Keith Herbert Gifford, Maumee, OH (US); Scott David Gill, Fort Wayne, IN (US); Daniele Casiraghi, Milan (IT)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/974,558

(22) Filed: Oct. 10, 2001

(65) Prior Publication Data

US 2002/0069668 A1 Jun. 13, 2002

(30) Foreign Application Priority Data

Oct. 30, 2000 (EP) ..... 00830714

(51) Int. Cl.[7] ..... F25B 41/06; F25B 13/00
(52) U.S. Cl. ..... 62/511; 62/527
(58) Field of Search ..... 62/511, 527, 324.6; 251/118

(56) References Cited

U.S. PATENT DOCUMENTS 3,875,755 A * 4/1975 Anderson et al. ..... 62/77
4,394,816 A 7/1983 Voorhis
4,558,603 A * 12/1985 Chosta et al. ..... 73/864.21
4,644,973 A 2/1987 Itoh et al.
5,186,021 A 2/1993 Keller
5,265,438 A 11/1993 Knowles et al.
5,507,468 A 4/1996 Evans

FOREIGN PATENT DOCUMENTS

EP 0 821 210 1/1998

OTHER PUBLICATIONS

Copy of the International Search Report in corresponding European Application No. 00830714.2–2301.

* cited by examiner

*Primary Examiner*—Melvin Jones
(74) *Attorney, Agent, or Firm*—Christopher H. Hunter; Joseph J. Pophal

(57) ABSTRACT

A shut-off valve for pressurized fluids in an air cooling/ heating apparatus that includes at least one condenser and at least one fluid evaporator communicating with each other by a pipe. The valve includes two ducts each containing a restrictor coaxially formed with a capillary designed to cause rapid expansion of the fluid when it emerges from the capillary, thus allowing expansion of the fluid in either the heating or cooling mode. The valve further includes a duct for sampling the pressurized fluid before expansion during operation in either the heating or cooling mode.

25 Claims, 7 Drawing Sheets

DUAL RESTRICTOR SHUT-OFF VALVE FOR PRESSURIZED FLUIDS OF AIR COOLING/ HEATING APPARATUS

RELATED CASES

The present application claims priority to European Patent Application Serial No. 00830714.2-2301; filed Oct. 30, 2000.

1. Field of the Invention

The present invention relates to a shut-off valve for pressurized fluids in an air cooling/heating system such as air conditioners and the like.

2. Background of the Invention

It is known in the art of air conditioners and heat pumps that a condenser and an evaporator must be placed in communication with each other by means of shut-off valves and other devices designed to cause expansion of the refrigerant as the refrigerant flows from one component to another.

Specifically, in refrigerant systems operating in both the cooling and heating modes, two expansion devices may be incorporated into one system allowing for expansion of the fluid in either direction. A shut-off valve may also be incorporated into a system when there is a need to terminate refrigerant flow, such as for example, during servicing. The refrigerant system may also include a sampling port for detecting and measuring the pressure of the high-pressure refrigerant before the refrigerant enters the expansion device. Furthermore, the ability to easily interchange the expansion device allows the degree of expansion to be selectively varied after installation of the shut-off valve.

Combining the shut-off valve, expansion devices and sampling device into one unit is desirable to reduce the complexity of a refrigerant system. However, known refrigerant systems lack a mechanism for sampling the liquid refrigerant before the liquid enters the expansion devices in both the cooling and heating modes. Therefore, a need exists for a shutoff valve that allows for sampling high-pressure liquid between two expansion devices.

SUMMARY OF THE INVENTION

The present invention resolves the above noted problem by providing a mechanism that permits sampling of fluid refrigerant before expansion in either the cooling or heating mode. In particular, a shut-off valve is disclosed that includes at least two ducts. A first duct is positioned in communication with an evaporator. A second duct is positioned in communication with a condenser. Preferably, a third duct is adapted for receiving an instrument for sampling the fluid. A restrictor is arranged within the first and second ducts wherein each restrictor is formed with a capillary through which fluid passes and which causes rapid expansion of the fluid when the fluid exits from the capillary. Each restrictor is confined to an area defined by a cartridge and the body of the valve allowing limited axial movement of the restrictor in the direction of the fluid flow.

In accordance with the preferred embodiment, an insert member retains a cartridge in the first duct. The insert member is preferably retained by a flared nut threaded onto an externally threaded end of the first duct thereby clamping a flared end of a pipe directly against a conical surface of the insert member forming a seal. A cartridge in the second duct is preferably retained by a pipe received in a counterbore created between the second duct and the cartridge. The pipe is fixedly attached to the body of the valve by brazing or other suitable means of attachment.

In operation, the pressurized fluid flows from duct one to duct two in the heating mode and from duct two to duct one in the cooling mode. The valve is arranged such that duct three, or the duct receiving the sampling instrument, is positioned between ducts one and two. In this arrangement, the instrument may measure the pressure of the fluid as it flows between duct one and duct two. The shut-off valve arrangement is advantageous because it allows the fluid to be sampled before expansion in either the heating or cooling mode.

In accordance with a second embodiment, each cartridge is retained by a pipe received in a counterbore created between each cartridge and the corresponding duct. The pipe is fixedly attached to the body of the valve by brazing or other suitable means of attachment. A brazed pipe connection is advantageous because it requires fewer elements than a flared pipe connection.

In accordance with a third embodiment, an insert member retains each cartridge in both the first and second ducts. Each insert member is retained by a nut threaded onto an externally threaded end of each duct thereby clamping a flared end of a pipe directly against a conical surface of the insert member forming a seal. A flared pipe connection is advantageous because the connection can be disassembled allowing the substitution of a restrictor with a different capillary diameter. The ability to interchange a restrictor allows the shut-off valve to be field serviced without the need for complex brazing operations.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
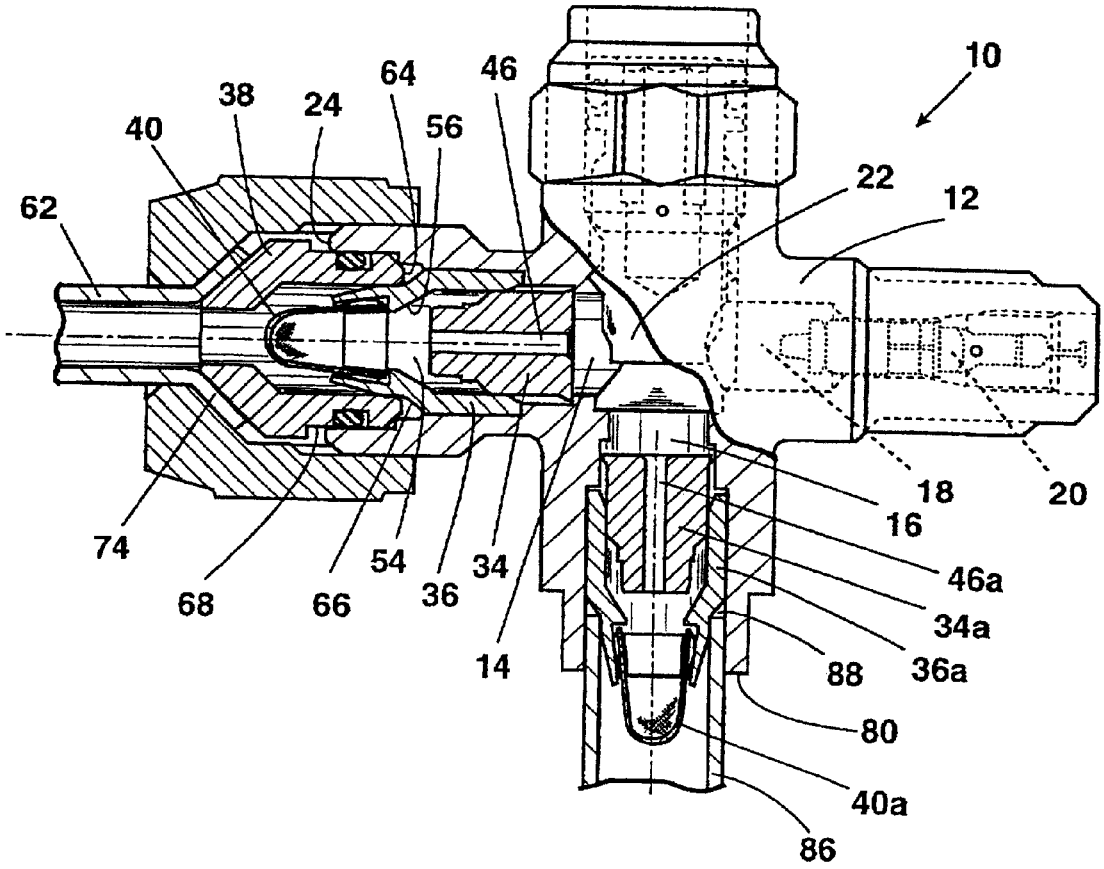
FIG. 1 is a partially sectioned view of a shut-off valve according to the present invention.
Figure 2:
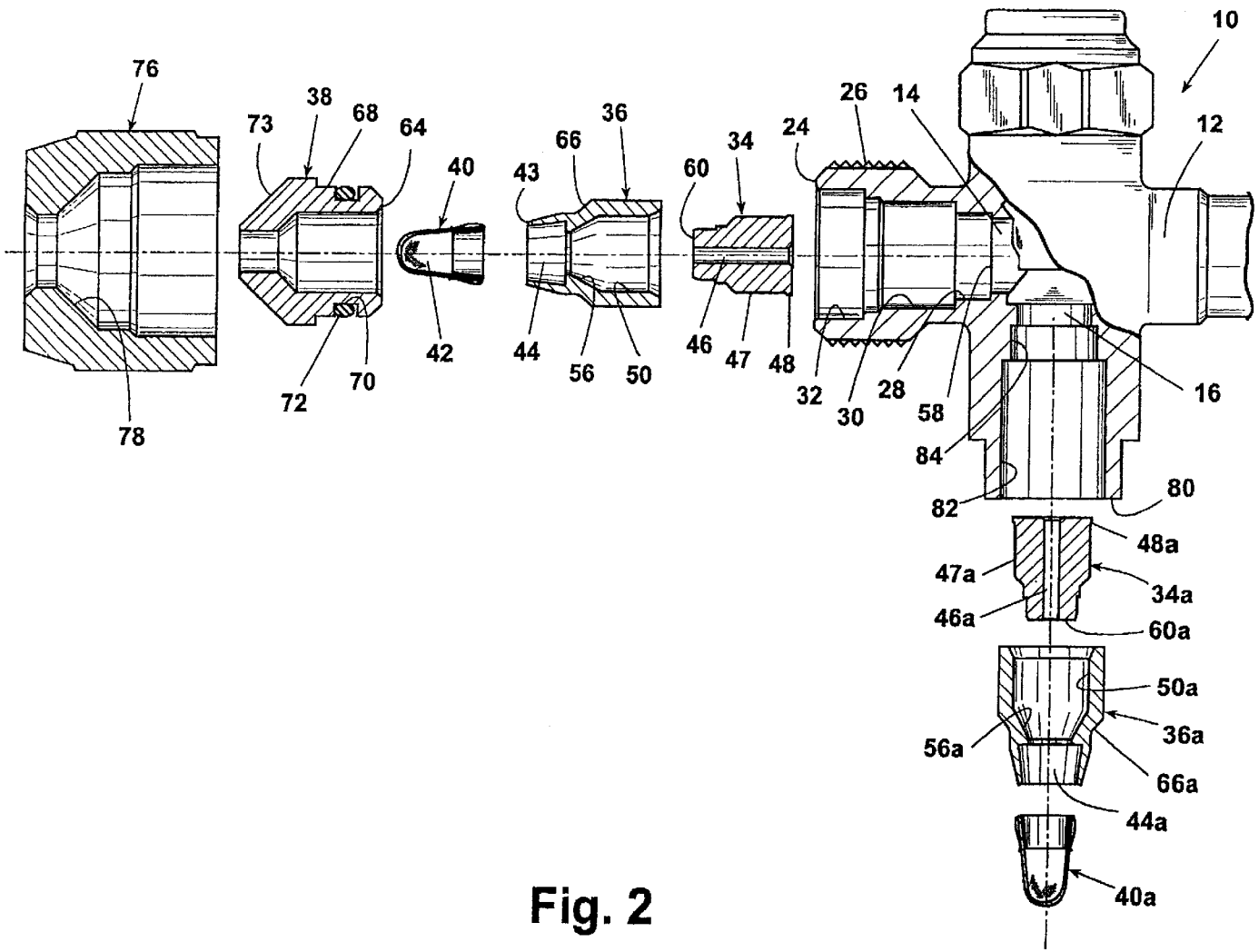
FIG. 2 is a partially sectioned exploded view of the shut-off valve.

Referring to FIGS. 1 and 2, a preferred embodiment of a shut-off valve 10 in accordance with the principles of the current invention is shown. Shut-off valve 10 includes a body 12 that has formed therethrough, at least two ducts. A first duct 14 communicates with an evaporator (not illustrated). A second duct 16 communicates with a condenser (not illustrated). Preferably, valve body 12 includes a third duct 18 that is adapted to receive a sampling mechanism 20 for allowing the detection and measurement of the fluid pressure between ducts 14, 16 and 18, to be explained in further detail below. Valve 10 further includes an obturator 22 that may be displaced by rotation between a closed position in which fluid flow between first duct 14 and second duct 16 is blocked (not shown) and an open position in which flow between first duct 14 and second duct 16 is permitted (shown as open in FIG. 1).

As seen in FIG. 2, first duct 14, that is in communication with the evaporator, is formed inside a first outlet 24 of body 12 with an external thread 26 located on body 12. Outlet 24 has positioned therein three coaxial seats 28, 30 and 32. Coaxial seats 28, 30 and 32 receive and house a restrictor 34, a cartridge 36 and an insert member 38 respectively.

The inside diameter of each coaxial seat 28, 30 and 32 is slightly larger than the outside diameter of restrictor 34, cartridge 36 and insert member 38 respectively, such that restrictor 34, cartridge 36 and insert member 38 are slidably assembled in their respective seats without interference. A filtering element 40, having a screen portion 42 of suitable gauge, is fixedly attached to a distal end 43 of cartridge 36 and is designed to trap contaminants in order to prevent blockage in the system. Preferably, filtering element 40 is retained within a forward chamber 44 of cartridge 36 by press fit engagement. However, other suitable attachment mechanisms may be employed.

Figure 5:
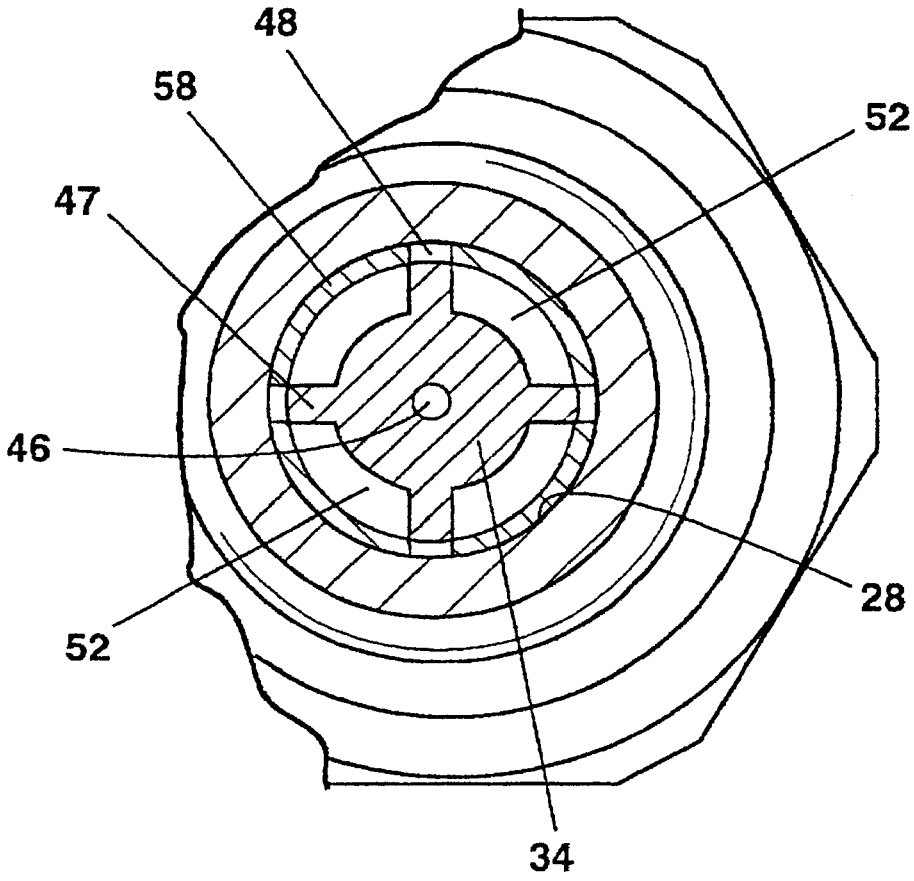
FIG. 5 is a cross sectional view along the plane indicated by 5—5 in FIG. 4.

Restrictor 34 is formed with an axial capillary duct 46 with a predetermined diameter that corresponds to the desired degree of expansion of the fluid. Restrictor 34 is provided with a plurality of radial fins 47 that terminate in a projection 48. Radial fins 47 cooperate with both an interior surface 50 of cartridge 36 and seat 28 to create a plurality of flow channels 52 (best seen in FIG. 5) for the free flow of fluid. A void 54, (best seen in FIG. 1) defined between an interior angled sealing surface 56 of cartridge 36 and a shoulder 58 of seat 28, allows for a limited degree of axial movement of restrictor 34. Projection 48 is designed to cooperate with shoulder 58 of seat 28 in order to limit axial movement of restrictor 44 in a direction towards obturator 22. Similarly, internally angled sealing surface 56 of cartridge 36 is designed to cooperate with a sealing end 60 of restrictor 34 to limit axial movement of restrictor 34 in a direction toward a connecting pipe 62.

Insert member 38 has an end portion 64 received within outlet 24 so as to engage an upper angled portion 66 of cartridge 36 and retain cartridge 36 in seat 30. A cylindrical portion 68 of insert member 38 engages seat 32 in outlet 24 so as to provide a seal to prevent the passage of fluid. Preferably, cylindrical portion 68 of insert member 38 is also formed with an annular seat 70 housing an annular sealing element 72 such as an O-ring. Insert member 38 further includes a conical surface 73 designed to cooperate with a flared end 74 of connecting pipe 62 to ensure a seal. Insert member 38 is preferably retained in seat 32 by a nut 76 that can be tightened on external thread 26 of outlet 24. An internal conical surface 78 of nut 76 acts against flared end 74 of connecting pipe 62 forming a seal between connecting pipe 62 and insert member 38.

Second duct 16, in communication with the condenser, is formed inside a second outlet 80 of body 12. Outlet 80 has formed therein two coaxial seats 82 and 84. Coaxial seats 82 and 84 receive and house a cartridge 36*a* and a restrictor 34*a* that are substantially identical to cartridge 36 and restrictor 34 in first duct 14. Cartridge 36*a* is retained in seat 82 by a second connecting pipe 86 that is positioned in a counterbore 88 created between an upper angled portion 66*a* of cartridge 36*a* and seat 82. Connecting pipe 86 is fixedly attached to valve body 12 preferably by brazing connecting pipe 86 to outlet 80. However other suitable methods of attaching connecting pipe 86 and outlet 80 may also be employed.

Figure 3:
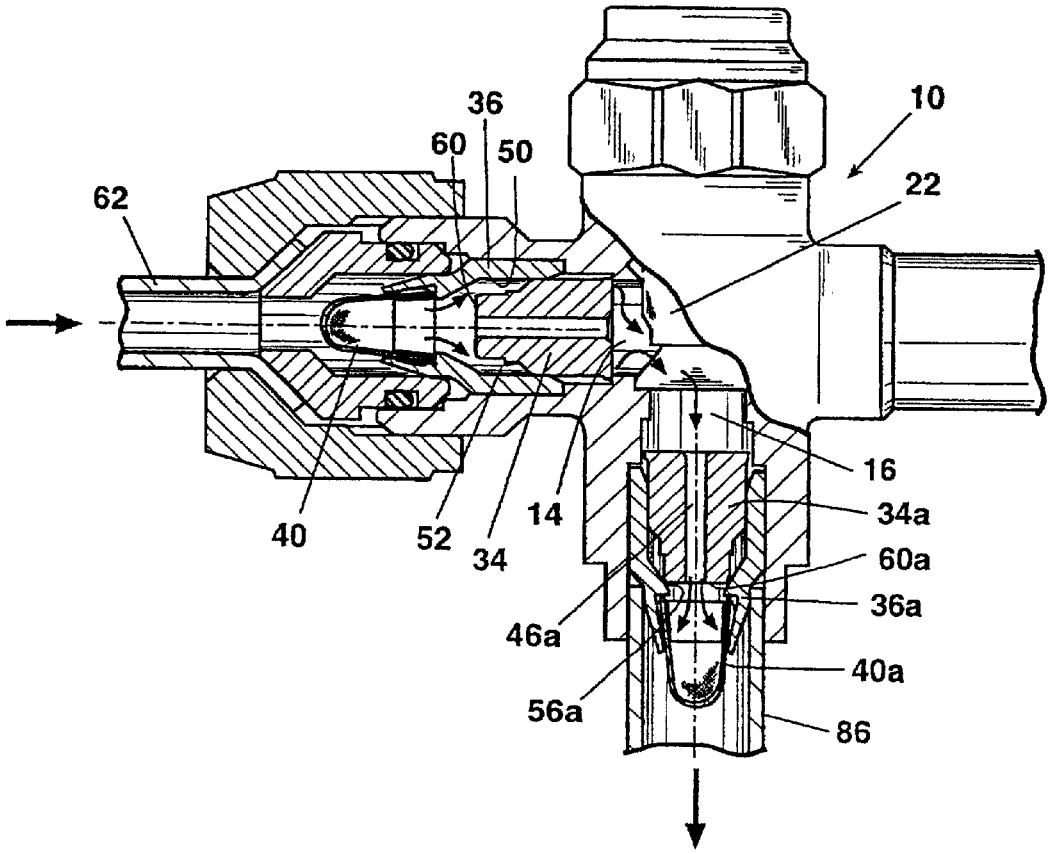
FIG. 3 is a partially sectioned view of the shut-off valve operating in the heating mode.

As illustrated in FIG. 3, during operation in the heating mode, fluid flows through valve 10 from connecting pipe 62 to connecting pipe 86, first passing through filtering element 40. The pressure of the fluid itself produces axial movement of restrictor 34 away from cartridge 36 thus causing opening of flow channels 52. In this configuration, the fluid from pipe 62 is able to flow freely around a sealing end 60 of restrictor 34 into first duct 14 through flow channels 52. When obturator 22 is in the open position, fluid may freely flow from first duct 14 into second duct 16 whereby the fluid encounters restrictor 34*a*. The pressure of the fluid itself produces movement of restrictor 34*a* until a sealing end 60*a* of restrictor 34*a* makes contact with an internal angled sealing surface 56*a* of cartridge 36*a*, thus effecting a seal. In this configuration, the fluid from second duct 16 is able to flow freely until it encounters restrictor 34*a* where, in order for it to pass through restrictor 34*a*, the fluid is necessarily channeled into capillary 46*a* causing expansion of the fluid as the fluid exits capillary 46*a* at sealing end 60*a*. The expanded fluid then exits valve 10 into pipe 86 through a filtering element 40*a*.

Figure 4:
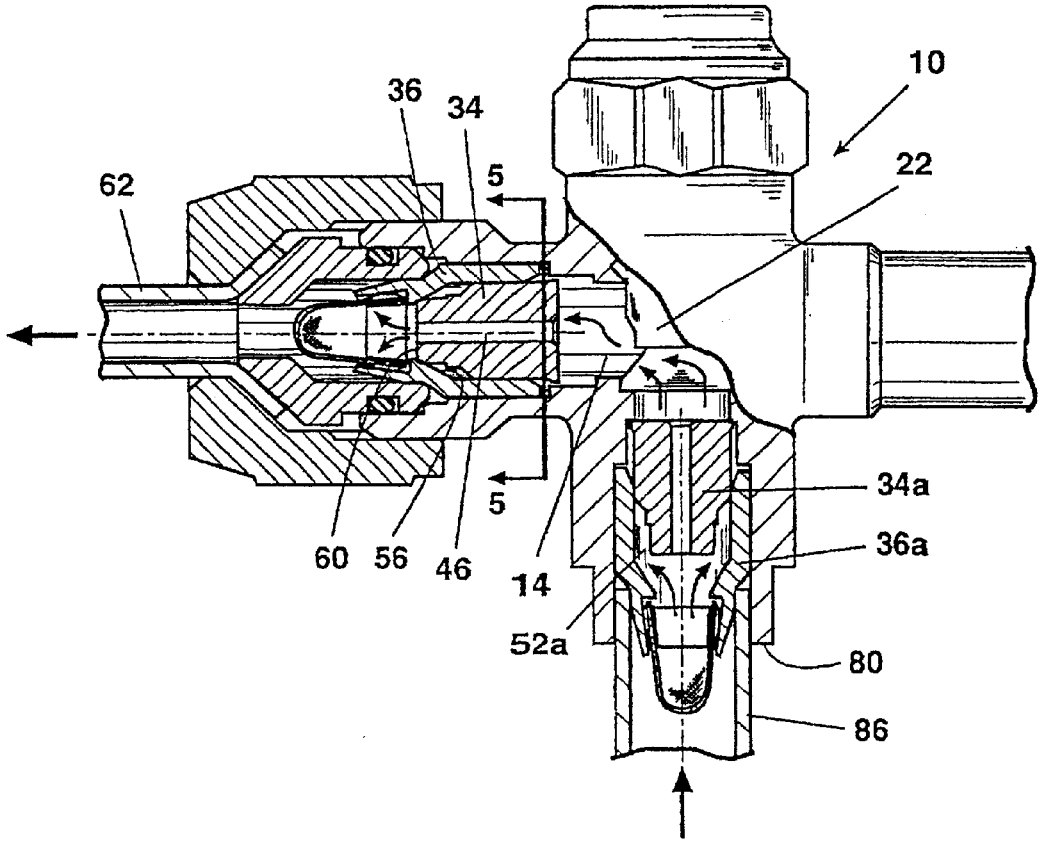
FIG. 4 is a partially sectioned view of the shut-off valve operating in the cooling mode.

Operation occurs in a substantially similar manner, but in the opposite direction, during operation of the valve in the cooling mode as illustrated in FIG. 4. During operation in the cooling mode, fluid enters outlet 80 through pipe 86 whereby fluid pressure produces movement in restrictor 34*a* away from cartridge 36*a* causing an opening of flow channels 52*a*. When obturator 22 is in the open position, fluid is then directed into duct 14 such that fluid pressure produces movement in restrictor 34 towards cartridge 36 to effect a seal between sealing end 60 of restrictor 34 and angled sealing surface 56 of cartridge 36. In this configuration, the fluid is able to flow freely until it encounters restrictor 34 where it is channeled through capillary 46 causing expansion of the fluid as the fluid exits capillary 46 at sealing end 60.

In operation, fluid flows through valve 10 from pipe 62 to pipe 86 in the heating mode and from pipe 86 to pipe 62 in the cooling mode. In the heating mode, fluid freely flows around restrictor 34 into duct 14. When the obturator 22 is in the open position, the fluid is then free to flow into duct 16 and duct 18. Once in duct 18, the fluid pressure may be detected and measured via sampling mechanism 20 received in duct 18. Operation occurs in a substantially similar manner, but in the opposite direction, during operation of the valve in the cooling mode.

Figure 6:
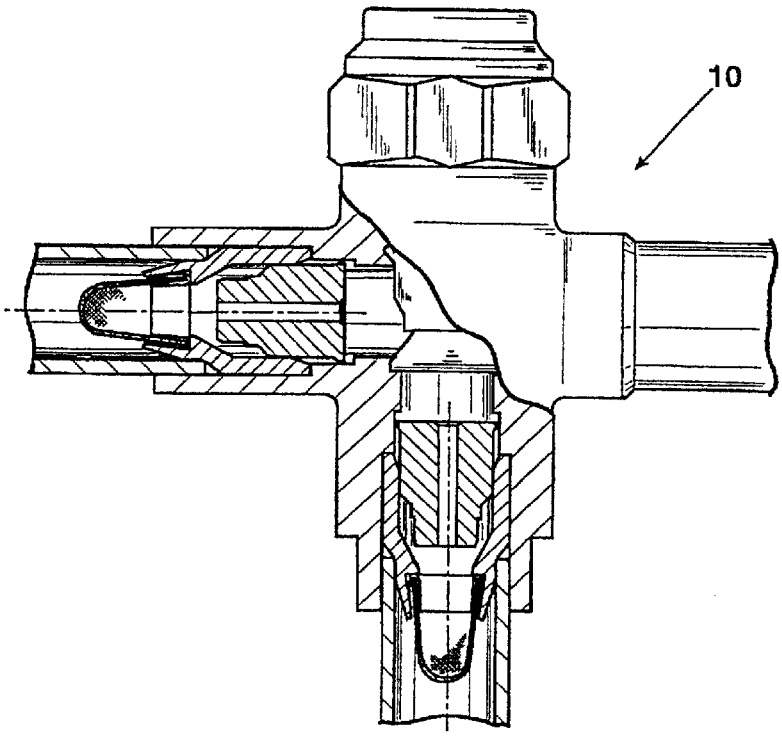
FIG. 6 is a partially sectioned view of a second embodiment of a shut-off valve having two brazed pipe connections.

FIG. 6 illustrates a variation of embodiment of valve 10 in which a brazed connection is used at both the first and second outlets. The valve operation and expansion process perform identically as described in the configurations illustrated in FIGS. 3 and 4. A brazed pipe connection is advantageous because it requires fewer assembly elements.

Figure 7:
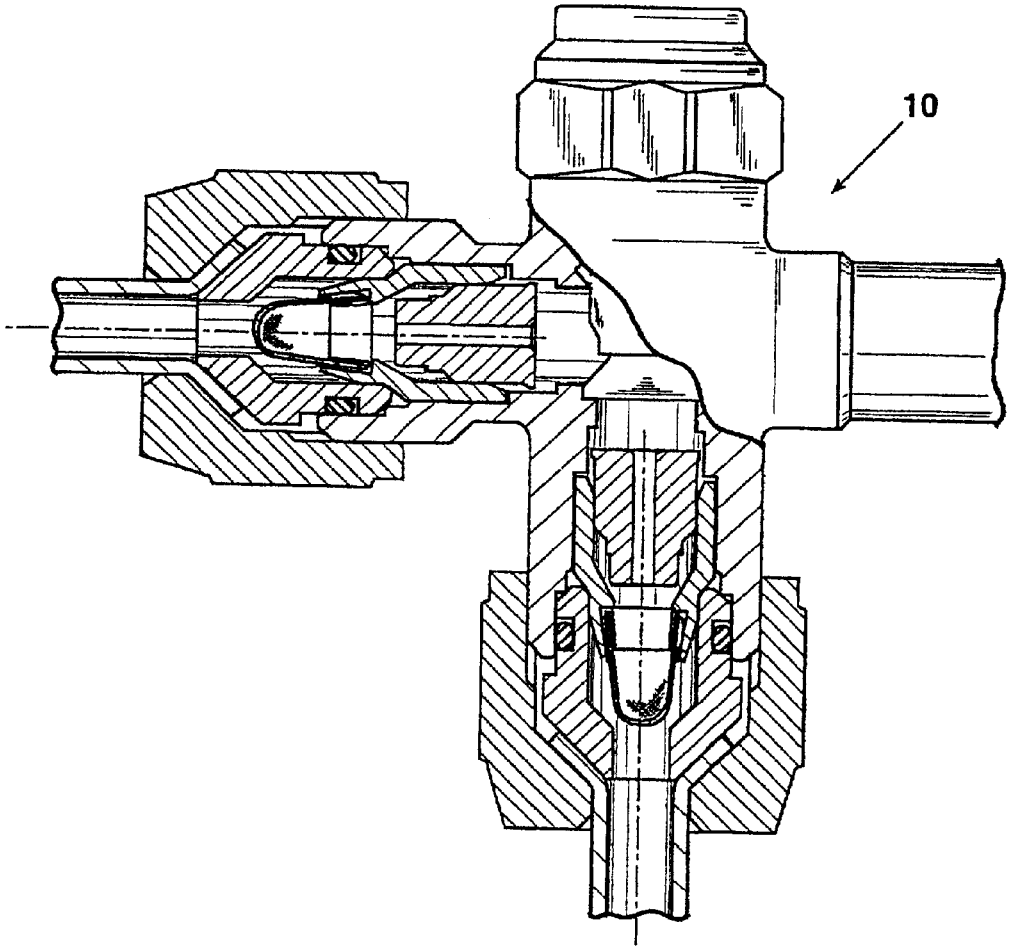
FIG. 7 is a partially sectioned view of a third embodiment of a shut-off valve having two flared pipe connections.

FIG. 7 illustrates a variation of the embodiment of valve 10 in which a flared connection is used at both the first and second outlets. The valve operation and expansion process perform identically as described in the configurations illustrated in FIGS. 3 and 4. A flared connection is advantageous because the connection can be easily disassembled allowing the substitution of restrictors. The ability to interchange a restrictor allows the shutoff valve to be field serviced without the need for complex brazing operations. Furthermore, restrictors with different capillary diameters may be employed such that the degrees of expansion may be selectively varied.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A shut-off valve for pressurized fluid in communication with at least one condensor and at least one fluid evaporator in an air cooling/heating apparatus, said valve comprising:

a first duct in communication with the evaporator and a second duct in communication with the condensor;

wherein said first and second ducts each further receive a cartridge, each of said cartridges receiving a restrictor, wherein the restrictor in each cartridge is coaxially formed with a capillary through which fluid passes and which causes rapid expansion of the fluid when the fluid exits from a distal end of said capillary; and wherein said valve further includes a sampling instrument located to sample fluid in said valve between said cartridges.

2. The valve according to claim 1, wherein each restrictor in said first and second ducts are capable of independent axial movement within said first and second ducts.

3. The valve according to claim 1, wherein an outer portion of each restrictor is formed with at least two radial fins, said fins cooperating with interior surfaces of said cartridges and seats formed in said first and second ducts to create at least one flow channel for fluid flow.

4. The valve according to claim 3, wherein each restrictor further includes a projection at one end of said radial fins, said projection cooperating with a shoulder in each of said first and second ducts to limit axial movement in a first predetermined direction.

5. The valve according to claim 1, wherein each cartridge has an interior angled sealing surface that cooperates with a sealing end of each restrictor to channel fluid flow through said capillary.

6. The valve according to claim 1, wherein a filtering element is fixedly attached to an end of said cartridges.

7. The valve according to claim 1, further including an insert member secured to an end of said first duct to clamp a flared end of a pipe directly against a conical surface of said insert member.

8. The valve according to claim 7, wherein said insert member is selectively secured to said first duct by threaded engagement.

9. The valve according to claim 1, further including a connecting pipe received in a counterbore created between a seat in the second duct and said cartridge, said pipe being fixedly attached to the valve.

10. The valve as in claim 1, wherein the fluid flows through the valve in opposite directions depending on whether the air cooling/heating apparatus is in one mode of operation or the other, and the cartridges each provide rapid expansion of fluid flow when the fluid flows in one direction through the cartridge and substantially free flow of fluid when the fluid flows in the opposite direction through the cartridge, and wherein the cartridges are located such that a downstream one of the cartridges in each mode of operation provides the rapid expansion of fluid, while an upstream one of the cartridges provides the free flow of fluid.

11. A shut-off valve for pressurized fluid in communication with at least one condenser and at least one fluid evaporator in an air cooling/heating apparatus, said valve comprising:

at least three ducts, a first duct in communication with the evaporator, a second duct in communication with the condenser, and a third duct for receiving an instrument for sampling fluid in said valve;

wherein said first and second ducts each further receive a cartridge, said cartridge receiving a restrictor, wherein the restrictor is coaxially formed with a capillary through which fluid passes and which causes rapid expansion of the fluid when the fluid exits from a distal end of said capillary.

12. The valve according to claim 11, wherein each restrictor in said first and second ducts are capable of independent axial movement within said first and second ducts.

13. The valve according to claim 11, wherein an outer portion of each restrictor is formed with at least two radial fins, said fins cooperating with interior surfaces of said cartridges and seats formed in said first and second ducts to create at least one flow channel for fluid flow.

14. The valve according to claim 11, wherein each cartridge has an interior angled sealing surface that cooperates with a sealing end of each restrictor to channel fluid flow through said capillary.

15. The valve according to claim 11, wherein each restrictor further includes a projection at one end of said radial fins, said projection cooperating with a shoulder in each of said first and second ducts to limit axial movement in a first predetermined direction.

16. The valve according to claim 11, wherein a filtering element is fixedly attached to an end of said cartridges.

17. The valve according to claim 16, wherein said filtering element is retained within a forward chamber of each cartridge by press fit engagement.

18. The valve according to claim 11, further including an insert member secured to an end of said first duct to clamp a flared end of a pipe directly against a conical surface of said insert member.

19. The valve according to claim 18, wherein said insert member is selectively secured to said first duct by threaded engagement.

20. The valve according to claim 11, further including a connecting pipe received in a counterbore created between a seat in the second duct and said cartridge, said pipe being fixedly attached to the valve.

21. The valve according to claim 11, wherein said third duct is located intermediate said first and second ducts, such that said fluid sampling instrument can sample fluid prior to the fluid passing through the restrictor in one cartridge when the air cooling/heating apparatus is in one mode of operation; and can sample fluid prior to the fluid passing through the restrictor in the other cartridge when the air cooling/heating apparatus is in another mode of operation.

22. The valve as in claim 21, wherein the cartridge is formed with a passage which allows the free flow of fluid in one direction, and the capillary causes rapid expansion of fluid when the fluid flows in an opposite direction, and the cartridges are located such that an upstream one of the cartridges in each mode of operation provides free flow of fluid while a downstream one of the cartridges provides rapid expansion of fluid.

23. A shut-off valve for pressurized fluid in communication with at least one condenser and at least one fluid evaporator in an air cooling/heating apparatus, said valve comprising:

a valve body formed with at least three ducts, a first duct in communication with an evaporator, a second duct in communication with a condenser, and a third duct for receiving an instrument for sampling fluid in said valve;

an obturator in said body displaceable by rotation between a closed position in which fluid flow between said first duct and said second duct is blocked and an open position in which fluid flow between said first duct and said second duct is permitted;

wherein said first and second ducts each further receive a cartridge, each of said cartridges receiving a restrictor, wherein said restrictor in each cartridge is coaxially formed with a capillary through which fluid passes and which causes rapid expansion of the fluid when the fluid exits from a distal end of said capillary;

wherein an outer portion of each restrictor is formed with at least two radial fins, said fins cooperating with interior surfaces of said cartridges and seats formed in said first and second ducts to create at least one flow channel for fluid flow;

wherein each cartridge has an interior angled sealing surface that cooperates with a sealing end of each restrictor to channel fluid flow through said capillary;

wherein said valve further includes an insert member secured to an end of said first duct to clamp a flared end of a pipe directly against a conical surface of said insert member; and wherein said valve further includes a connecting pipe received in a counterbore created between a seat in the second duct and said cartridge, said pipe being fixedly attached to the valve.

24. The valve as in claim 23, and further including a sampling instrument located to sample fluid in said valve between the cartridges.

25. The valve as in claim 24, wherein the fluid flows through the valve in opposite directions depending on whether the air cooling/heating apparatus is in one mode of operation or the other, and the cartridges each provide rapid expansion of fluid flow when the fluid flows in one direction through the cartridge and substantially free flow of fluid when the fluid flows in the opposite direction through the cartridge, and wherein the cartridges are located such that a downstream one of the cartridges in each mode of operation provides the rapid expansion of fluid, while an upstream one of the cartridges provides the free flow of fluid.

* * * * *